US008595984B1

(12) United States Patent
Wells

(10) Patent No.: US 8,595,984 B1
(45) Date of Patent: Dec. 3, 2013

(54) FLEXIBLE DOOR SEAL DEVICE

(76) Inventor: John D. Wells, Cornelius, NC (US)

( * ) Notice: Subject to any disclaimer, the term of this patent is extended or adjusted under 35 U.S.C. 154(b) by 0 days.

(21) Appl. No.: 13/406,379

(22) Filed: Feb. 27, 2012

(51) Int. Cl.
*E06B 7/16* (2006.01)

(52) U.S. Cl.
USPC ..... 49/479.1; 49/475.1

(58) Field of Classification Search
USPC ..... 49/475.1, 479.1, 490.1, 496.1, 400, 49/401, 402
See application file for complete search history.

(56) References Cited

U.S. PATENT DOCUMENTS

| | | | | | |
|---|---|---|---|---|---|
| 2,139,312 | A | * | 12/1938 | Mullens | 49/462 |
| 2,428,731 | A | * | 10/1947 | Abrams | 49/490.1 |
| 2,899,720 | A | * | 8/1959 | Vollmer | 49/479.1 |
| 3,518,792 | A | * | 7/1970 | Urbanick et al. | 49/490.1 |
| 3,602,405 | A | * | 8/1971 | Ames | 222/386 |
| 3,717,955 | A | * | 2/1973 | Urbanick | 49/479.1 |
| 3,761,347 | A | * | 9/1973 | Yackiw | 428/126 |
| 3,886,686 | A | * | 6/1975 | Urbanick | 49/490.1 |
| 4,001,974 | A | * | 1/1977 | Wright | 49/489.1 |
| 4,015,368 | A | * | 4/1977 | Court et al. | 49/489.1 |
| 4,119,325 | A | * | 10/1978 | Oakley et al. | 277/642 |
| 4,178,717 | A | * | 12/1979 | Sakauye | 49/70 |
| 4,300,528 | A | * | 11/1981 | Slemmons | 126/545 |
| 4,403,451 | A | * | 9/1983 | Douillard | 49/475.1 |
| 4,716,683 | A | | 1/1988 | Minter | |
| 4,888,917 | A | * | 12/1989 | Mesnel et al. | 49/479.1 |
| 5,107,622 | A | * | 4/1992 | Fuchs et al. | 49/484.1 |
| 5,214,880 | A | | 6/1993 | Woodruff et al. | |
| 5,475,948 | A | * | 12/1995 | Parke | 49/506 |
| 5,499,475 | A | * | 3/1996 | Court et al. | 49/495.1 |
| 5,528,864 | A | * | 6/1996 | Jennings | 49/490.1 |
| 6,158,171 | A | * | 12/2000 | Kellogg et al. | 49/489.1 |
| 6,478,308 | B1 | * | 11/2002 | McMillin et al. | 277/630 |
| 6,560,932 | B2 | * | 5/2003 | Heroux | 49/469 |
| 7,891,136 | B1 | | 2/2011 | Heroux | |
| 8,141,298 | B2 | * | 3/2012 | Heroux | 49/470 |
| 8,161,685 | B2 | * | 4/2012 | Salgado | 49/470 |
| 2005/0252084 | A1 | | 11/2005 | Antoshak | |
| 2005/0268559 | A1 | * | 12/2005 | Ellingson | 49/475.1 |
| 2011/0113696 | A1 | * | 5/2011 | Gallagher | 49/493.1 |
| 2011/0120023 | A1 | * | 5/2011 | Heroux | 49/475.1 |
| 2011/0283627 | A1 | * | 11/2011 | Shaw | 49/478.1 |
| 2012/0222361 | A1 | * | 9/2012 | Farucci et al. | 49/475.1 |

* cited by examiner

*Primary Examiner* — Katherine Mitchell
*Assistant Examiner* — Justin Rephann

(57) ABSTRACT

The flexible door seal device provides for sealing against air leaks around a door and doorway without interfering with door opening and closing. The flexible device is easily installed and removed without need of any tools. Also, the device can be rolled or folded into a compact size for transport and storage as needed. The device is self-retained until removed from a door. Retention is accomplished by way of the pockets disposed at each corner. Ideally, the device may be seamless. The device provides a positive seal by way of the insert and the inner flap and outer flap that overlap any space between a door and a jamb. The outer flap is sufficient to overlap drywall, trim, and other door surrounds.

2 Claims, 5 Drawing Sheets

FLEXIBLE DOOR SEAL DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Sealing a door against air leaks has remained a challenge throughout the years. Various devices have been attempted to address the problem. The current removable, flexible device provides a positive seal against air leaks around the side, top and corners of a door.

FIELD OF THE INVENTION

The flexible door seal device relates to devices for sealing doors against air leaks.

SUMMARY OF THE INVENTION

The general purpose of the flexible door seal device, described subsequently in greater detail, is to provide a flexible door seal device which has many novel features that result in an improved flexible door seal device which is not anticipated, rendered obvious, suggested, or even implied by prior art, either alone or in combination thereof.

To attain this, the flexible door seal device provides for sealing against air leaks around a door and doorway without interfering with door opening and closing. The flexible device is easily installed and removed without need of any tools. Also, the device can be rolled or folded into a compact size for transport and storage as needed. The device is self-retained until removed from a door. Retention is accomplished by way of the pockets disposed at each corner. Ideally, the device may be seamless. The device provides a positive seal by way of the insert and the inner flap and outer flap that overlap any space between a door and a jamb. The outer flap is sufficient to overlap drywall, trim, and other door surrounds.

Thus has been broadly outlined the more important features of the improved flexible door seal device so that the detailed description thereof that follows may be better understood and in order that the present contribution to the art may be better appreciated.

An object of the flexible door seal device is to prevent air leaks around a door and door jamb.

Another object of the flexible door seal device is to be removably installed.

A further object of the flexible door seal device is to be easily installed.

And, an object of the flexible door seal device is to be self-retained.

An added object of the flexible door seal device is to be installed without tools.

And, an object of the flexible door seal device is to be easily transported.

An object of the flexible door seal device is to be collapsible.

Still another object of the flexible door seal device is to negate potential interference with a door's opening and closing.

These together with additional objects, features and advantages of the improved flexible door seal device will be readily apparent to those of ordinary skill in the art upon reading the following detailed description of presently preferred, but nonetheless illustrative, embodiments of the improved flexible door seal device when taken in conjunction with the accompanying drawings.

DETAILED DESCRIPTION OF THE DRAWINGS

With reference now to the drawings, and in particular FIGS. 1 through 6 thereof, the principles and concepts of the flexible door seal device generally designated by the reference number 10 will be described.

Figure 1:
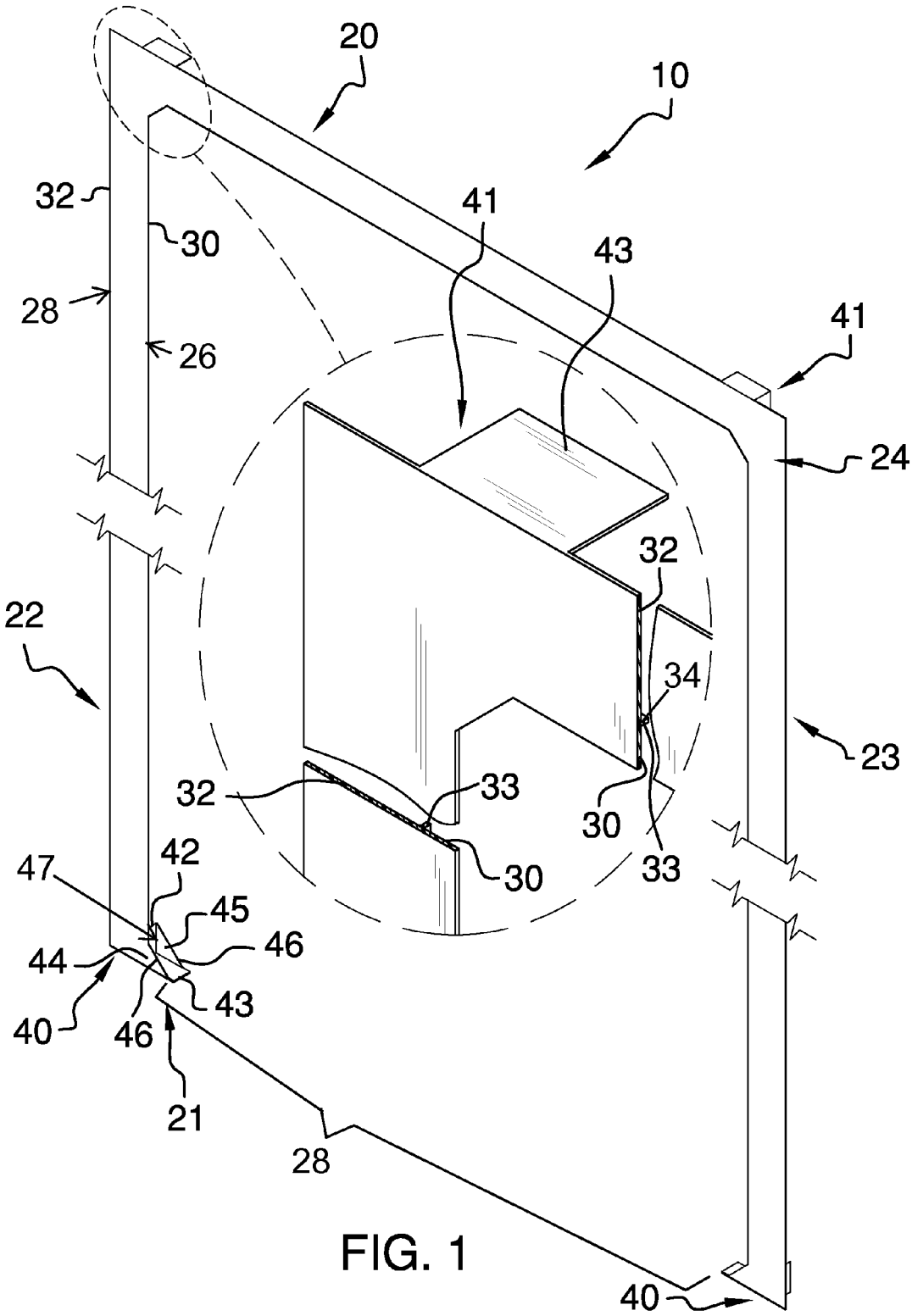
FIG. 1 is a front perspective view.

Referring to FIG. 1, the device 10 partially comprises a frame 19 having a top side 20 spaced apart from a bottom side 21, a first side 22 spaced apart from a second side 23. The bottom side 21 has a central opening 28.

Figure 4:
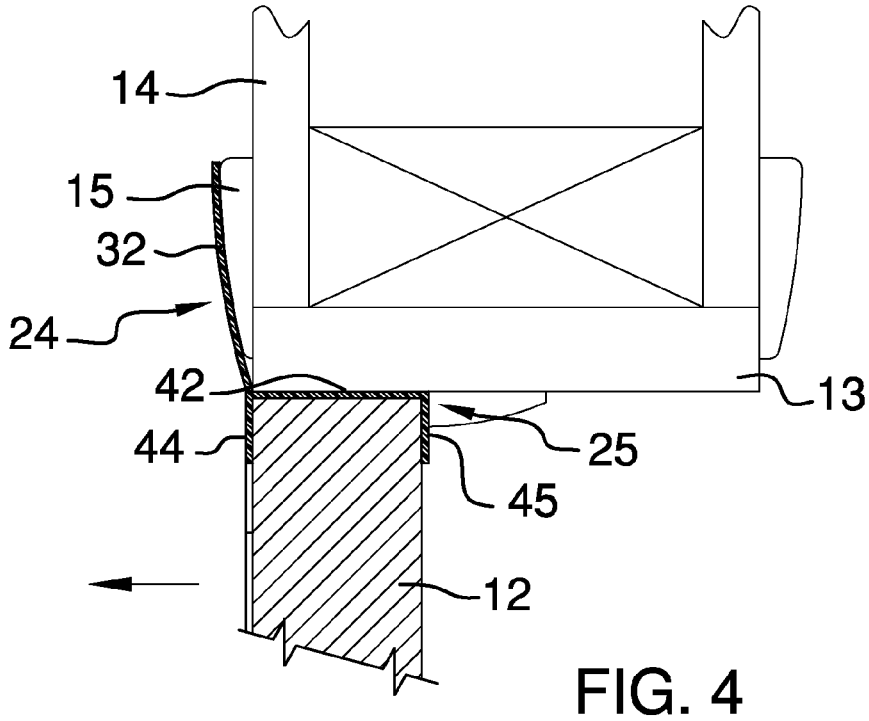
FIG. 4 is a partial cross sectional view of FIG. 3, taken along the line 4-4.

Referring to FIG. 4, the frame 19 also has a front side 24 spaced apart from a back side 25, a continuous inner perimeter 26 and a continuous outer perimeter 27.

Referring again to FIG. 1, an inner flap 30 is continuously disposed along the inner perimeter 26 of the frame 19. An outer flap 32 is continuously disposed along the outer perimeter 27 of the frame 19.

Referring to FIG. 5 and again to FIG. 1, a T-shaped insert 33 has a rear portion 34 extended from the front side 24 toward the back side 25 and is centrally disposed between the inner flap 30 and the outer flap 32 and a front portion 36.

Referring to FIG. 6 and also again to FIG. 1 a quartet of corner pockets comprises a pair of bottom pockets 40 and a pair of top pockets 41. Each bottom pocket 40 comprises a vertical wall 42 comprising a portion of the insert 33 at the bottom side 21 extended to the back side 25. A horizontal wall 43 is joined at a right angle to the vertical wall 42 and extends along a portion of the bottom side 21. A triangular back wall 45 connects the vertical wall 42 and the horizontal wall 43 at the back side 25 and the bottom side 21. A triangular forward wall 44 connects the inner flap 30 to the horizontal wall 43 at the bottom side 21. Each of the forward wall 44 and the back wall 45 has an upper side 46 with the upper sides being parallel to each other. A cavity 47 is disposed between the vertical wall 42, the horizontal wall 43, the back wall 45, and the forward wall 44 of each of the bottom pockets 40 and the top pockets 41. The cavity 47 is configured to receive a respective corner of an extant door". The top side 20 is attached between each of the top pockets 41.

Figure 2:
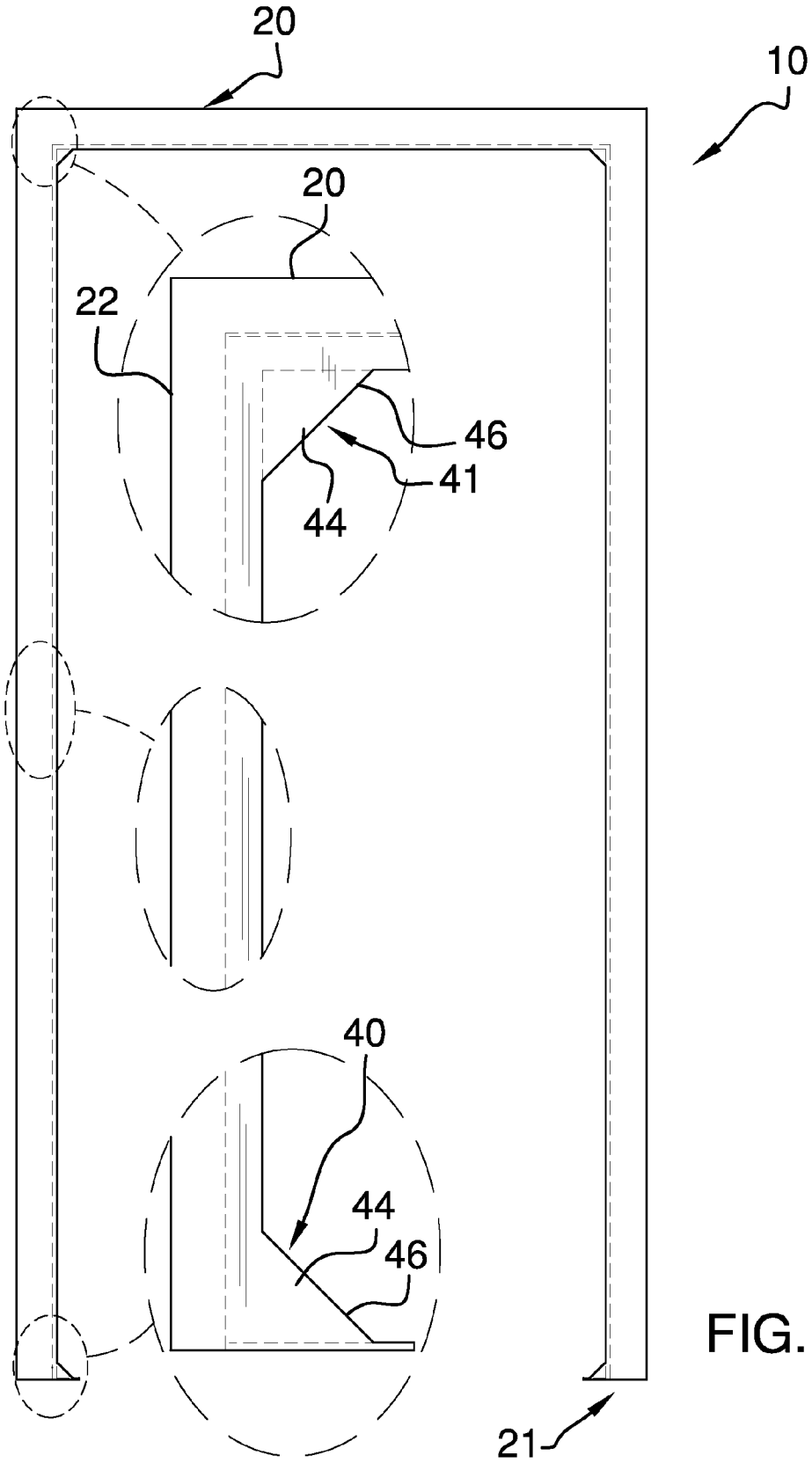
FIG. 2 is a front elevation view including segmented views.
Figure 3:
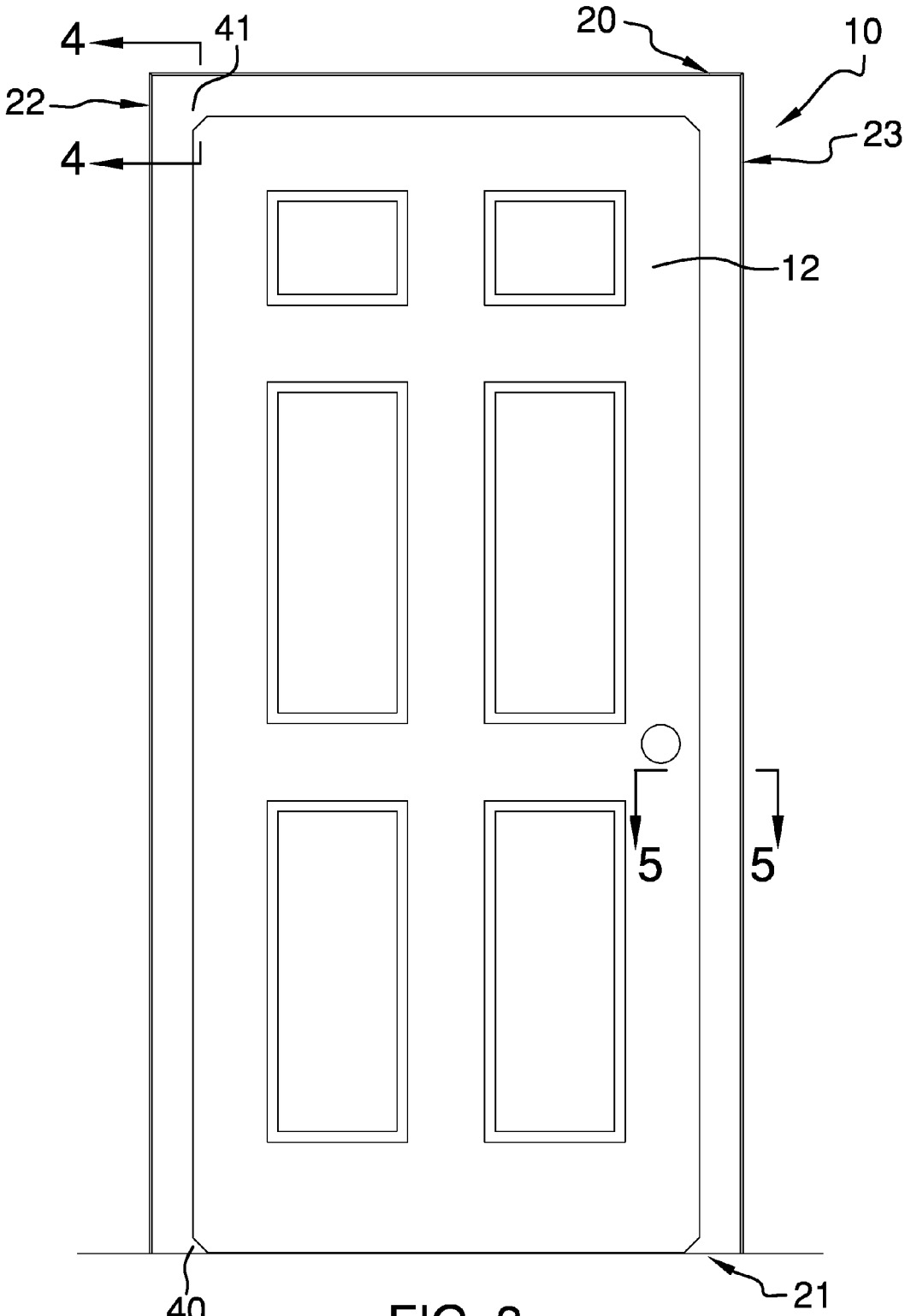
FIG. 3 is an in-use front elevation view.

Referring to FIGS. 2 and 3, the entire device 10 is preferably a one-piece structure.

Referring to FIG. 4, the outer flap 32 comprises sufficient flexibility to easily cover the trim 15 that typically overlaps the drywall 14, thereby ensuring against air leaks in such areas.

Figure 5:
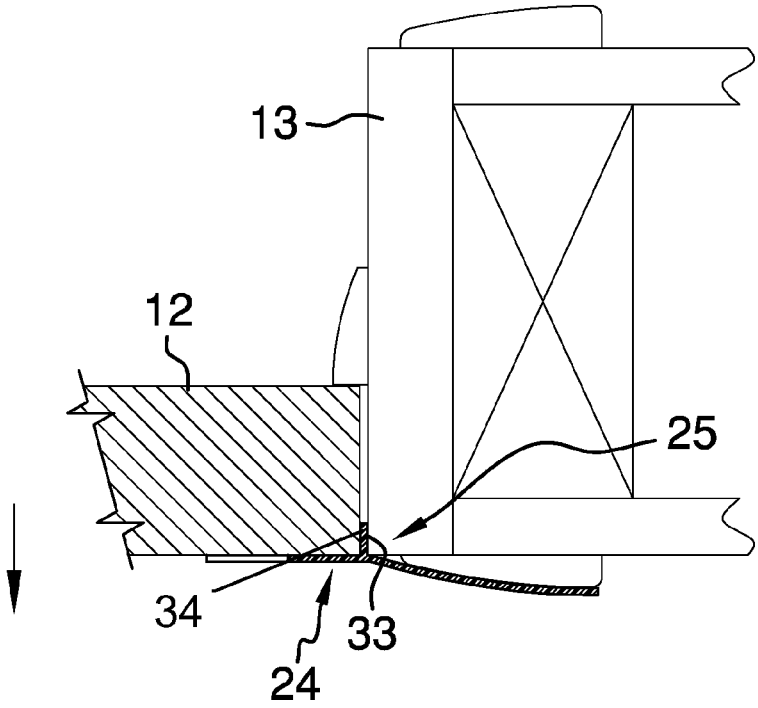
FIG. 5 is a partial cross sectional view of FIG. 3, taken along the line 5-5.
Figure 6:
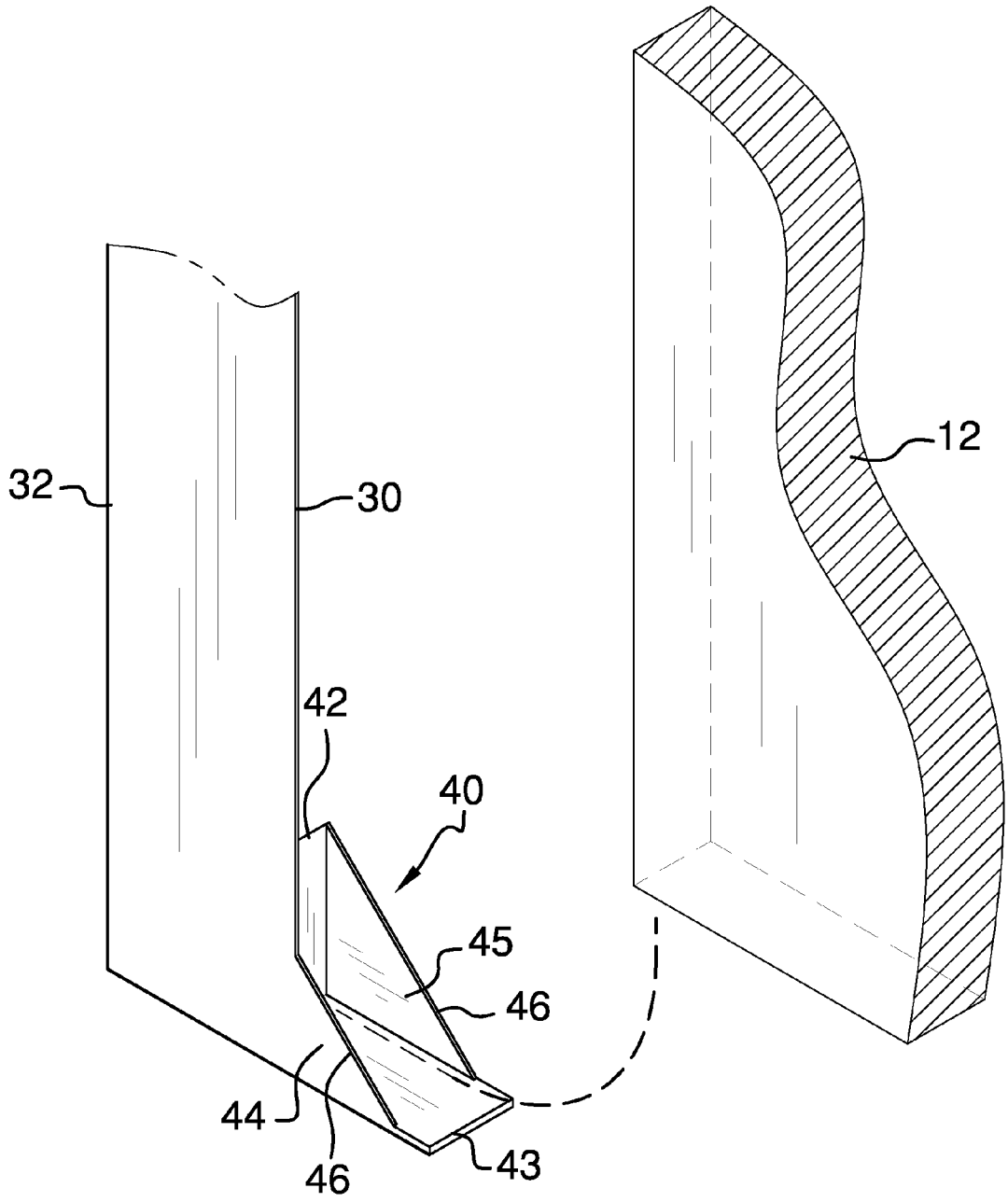
FIG. 6 is a front perspective view of the bottom first side.

Referring to FIG. 5, the insert 33 not only aids in locating the device 10, but also seals between the door 12 and the jamb 13.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the flexible door seal device may be used.

What is claimed is:

1. A flexible door seal device comprising, in combination:

a frame having a top side spaced apart from a bottom side, a first side spaced apart from a second side, a front side spaced apart from a back side, a continuous inner perimeter, and a continuous outer perimeter, the bottom side having a central opening;

an inner flap continuously disposed along the inner perimeter of the frame;

an outer flap continuously disposed along the outer perimeter of the frame;

a T-shaped insert having a front portion and a rear portion, the rear portion extended from the front side toward the back side and centrally disposed between the inner flap and the outer flap; and a quartet of corner pockets comprising a pair of bottom pockets and a pair of top pockets, each of the bottom pockets comprising:

a vertical wall comprising a portion of the insert at the bottom side extended to the back side;

a horizontal wall joined at a right angle to the vertical wall and extended along a portion of the bottom side;

a triangular back wall connecting the vertical wall and the horizontal wall at the back side and the bottom side;

a triangular forward wall connecting the inner flap to the horizontal wall, each of the forward wall and the back wall having an upper side, the upper sides being parallel to each other;

each of the top pockets comprising:

a vertical wall comprising a portion of the insert at the top side extended to the back side;

a horizontal wall joined at a right angle to the vertical wall and extended along a portion of the top side;

a triangular back wall connecting the vertical wall and the horizontal wall at the back side and the top side;

a triangular forward wall connecting the inner flap to the horizontal wall, each of the forward wall and the back wall having an upper side, the upper sides being parallel to each other; and a cavity disposed between the vertical wall, the horizontal wall, the back wall, and the forward wall of each of the bottom pockets and the top pockets;

wherein the cavity is configured to receive a respective corner of an extant door.

2. A flexible door seal device comprising, in combination:

a one-piece frame having a top side spaced apart from a bottom side, a first side spaced apart from a second side, a front side spaced apart from a back side, a continuous inner perimeter, and a continuous outer perimeter, the bottom side having a central opening;

an inner flap continuously disposed along the inner perimeter of the frame;

an outer flap continuously disposed along the outer perimeter of the frame;

a T-shaped insert having a front portion and a rear portion, the rear portion extended from the front side toward the back side and centrally disposed between the inner flap and the outer flap;

a quartet of corner pockets comprising a pair of bottom pockets and a pair of top pockets, each of the bottom pockets comprising:

a vertical wall comprising a portion of the insert at the bottom side extended to the back side;

a horizontal wall joined at a right angle to the vertical wall and extended along a portion of the bottom side;

a triangular back wall connecting the vertical wall and the horizontal wall at the back side and the bottom side;

a triangular forward wall connecting the inner flap to the horizontal wall, each of the forward wall and the back wall having an upper side, the upper sides being parallel to each other;

each of the top pockets comprising:

a vertical wall comprising a portion of the insert at the top side extended to the back side;

a horizontal wall joined at a right angle to the vertical wall and extended along a portion of the top side;

a triangular back wall connecting the vertical wall and the horizontal wall at the back side and the top side;

a triangular forward wall connecting the inner flap to the horizontal wall, each of the forward wall and the back wall having an upper side, the upper sides being parallel to each other; and a cavity disposed between the vertical wall, the horizontal wall, the back wall, and the forward wall of each of the bottom pockets and the top pockets;

wherein the cavity is configured to receive a respective corner of an extant door.

* * * * *